United States Patent [19]

Mohs et al.

[11] Patent Number: 4,739,883

[45] Date of Patent: Apr. 26, 1988

[54] RECLOSABLE DISPLAY PACKAGE

[75] Inventors: Thomas J. Mohs, Madison; Rodney D. Borst, Oregon, both of Wis.

[73] Assignee: Placon Corporation, Madison, Wis.

[21] Appl. No.: 17,115

[22] Filed: Feb. 20, 1987

[51] Int. Cl.[4] ..... B65D 73/00

[52] U.S. Cl. ..... 206/470; 206/467; 206/461

[58] Field of Search ..... 206/470, 461, 462, 471, 206/806

[56] References Cited

U.S. PATENT DOCUMENTS

| | | | |
|---|---|---|---|
| 3,463,309 | 8/1969 | Szostek | 206/470 |
| 3,579,883 | 5/1971 | Hayes . | |
| 3,620,411 | 11/1971 | Rump . | |
| 3,645,384 | 2/1972 | Wind . | |
| 3,800,998 | 4/1974 | Gask . | |
| 3,937,389 | 2/1976 | Wind . | |
| 4,058,212 | 11/1977 | Wyslotsky . | |
| 4,199,058 | 4/1980 | Lense et al. . | |
| 4,202,464 | 8/1980 | Mohs et al. . | |
| 4,225,077 | 9/1980 | Veitinger . | |
| 4,319,684 | 3/1982 | Backman et al. | 206/470 |
| 4,356,919 | 11/1982 | Matney | 206/470 |
| 4,383,607 | 5/1983 | Lordahl et al. . | |
| 4,423,811 | 1/1984 | Knapp . | |
| 4,427,129 | 1/1984 | Wyslotsky et al. . | |
| 4,449,629 | 5/1984 | Barrieau . | |
| 4,456,124 | 6/1984 | Kay et al. | 206/470 |
| 4,469,226 | 9/1984 | Matney | 206/470 |
| 4,499,353 | 2/1985 | Shields | 206/470 |
| 4,512,474 | 4/1985 | Harding | 206/470 |

OTHER PUBLICATIONS

Photographs of Modified Clam Shell Box used by Black and Decker.

"Packaging Charges Up Electrical Hardware," *Packaging Digest*, p. 62, vol. 23, No. 11, Oct. 1986.

*Primary Examiner*—Joseph Man-Fu Moy

*Attorney, Agent, or Firm*—Isaksen, Lathrop, Esch, Hart & Clark

[57] ABSTRACT

A reclosable display package of thin flexible thermoformed plastic material includes a rear base having a recess for containing any articles to be displayed, and substantially flat mating surface surrounding the recess and extending upwardly to a rear top edge, and two forwardly beveled rear base side flanges and one rear base bottom flange which extend rearwardly from three other edges of the flat mating surface to form a rear base skirt. Additionally, the display package includes a front cover which is integrally hinged along a hinge line to the non-beveled rear base bottom flange and is movable between open and closed positions, the front cover having a front plane which extends upwardly to a front top edge, two front cover side flanges which are forwardly beveled and one front cover bottom flange which extend rearwardly from three other edges of the front plane to form a front cover skirt. A flat inscription card may be inserted between the front cover and rear base so that the inscription card lies flat against the front plane, and even may extend upwardly between the front plane and flat mating surface beyond or to the front top edge and rear top edge without being folded within the closed package.

16 Claims, 2 Drawing Sheets

RECLOSABLE DISPLAY PACKAGE

BACKGROUND OF INVENTION

1. Field of Invention

This invention pertains generally to the field of packaging and containers, and particularly to reclosable display packages thermoformed from thin flexible plastic material.

2. Description of the Prior Art

Various types of reclosable display packages are currently used for the packaging of consumer articles. One common type of package is known as the "clam shell" package. "Clam shells" generally include a rear base and a front cover which are hinged together, and mating skirts all the way around both the cover and base which join together when the front cover is closed over the rear base. "Clam shells" often have means for releasably locking the cover over the base, and a means for hanging the package. Inscription cards may be placed within "clam shell" display packages against a planar portion of either the cover or the base, but often the dimensions of this card are limited by the four walls or the four flanges which form the mating skirt of the cover or base. In one "clam shell" display package, one of the flanges which forms a part of the mating skirt of the base extends rearwardly from the mating ridge portion of the base at an obtuse angle, and the corresponding flange on the cover extends rearwardly from the flat mating portions of the cover at the same obtuse angle so the two flanges mate. Since this angle is obtuse instead of perpendicular, an inscription card can be placed within the package not only against the flat planar portions, but also between these two mated obtuse flanges and up between the portions of the package which together form the hang tab. The inscription card, however, must be bent along a first line at the bottom of the two mated obtuse flanges, and at a second line at the top of the two mated obtuse flanges.

SUMMARY OF THE INVENTION

The present invention solves the aforementioned and other problems of the prior art, and provides improved enclosable display package of thin flexible material for small articles and the like. The package includes a thin-walled body of flexible plastic with a rear base forming a recess for any desired articles together with a front cover joined to the rear base by an integral hinge.

A reclosable display package of thin flexible thermoformed plastic material according to the present invention has a rear base with a rearward recess for containing any articles to be displayed, a substantially flat mating surface surrounding the recess and extending upwardly to the rear top edge, and two rear base side flanges and one rear base bottom flange which extend rearwardly from three other edges of the flat mating surface to form a rear base skirt. The two rear base side flanges are each beveled forwardly along an external rearward edge toward the rear top edge of the flat mating surface.

The reclosable display package further includes a rectangular front cover which is integrally hinged to the non-beveled rear base bottom flange and is movable between opened and closed positions, the front cover having a front plane which extends upwardly to a front top edge of the front plane, two front cover side flanges and one front cover bottom flange which extend rearwardly from three other edges of the front plane to form a front cover skirt. The two front cover side flanges are each beveled forwardly along an external rearward edge toward the front top edge of the front plane, as are the two beveled rear base side flanges. When the front cover is in a closed position on the rear base, the front cover flanges telescopically mate around the rear base flanges, and the flat mating surface mates with the front plane. No front mating surface is necessary since the front plane performs the function of mating with the rear mating surface, a substantially flat mating surface. In addition, the reclosable display package includes means for releasably locking the front cover on the rear base. Either or both upper portions of the front plane and flat mating surface above the rearward recess form a hang tab by which the package may be hung for displaying articles when the package is closed. A flat inscription card may lie against the front plane of the front cover such that when the front cover is in a closed position on the rear base and flat inscription card, the flat mating surface mates with the front plane, being separated from the front plane by only the flat non-folded inscription card. This non-folded inscription card may extend upwardly to or even beyond the front top edge of the front plane and the rear top edge of the flat mating surface. The reclosable display package of the present invention can utilize an inscription card which extends upwardly substantially beyond the rearward recess without being folded. The preferred means for releasably locking the front cover in a closed position on the rear base includes at least one locking projection near the front top edge of the front plane, and an equal number of locking cavities near the rear top edge, so that when the front cover is in closed position on the rear base the locking projections fit snugly within the locking cavities to lock releasably the front cover in closed position.

Further objects, features, and advantages of the invention will be apparent from the following detailed description when taken in conjunction with the accompanying drawings.

DESCRIPTION OF THE PREFERRED EMBODIMENT

Figure 1:
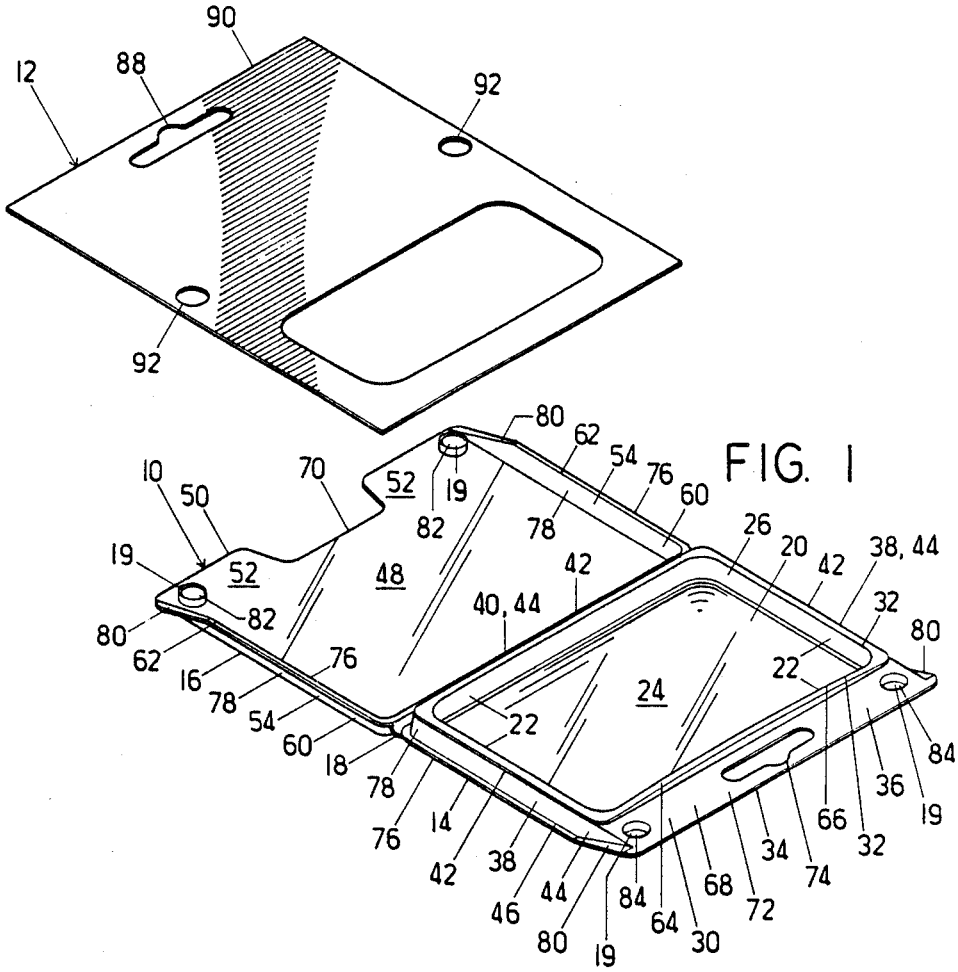
FIG. 1 is a perspective view of a reclosable display package with inscription card projected away from the open package.
Figure 2:
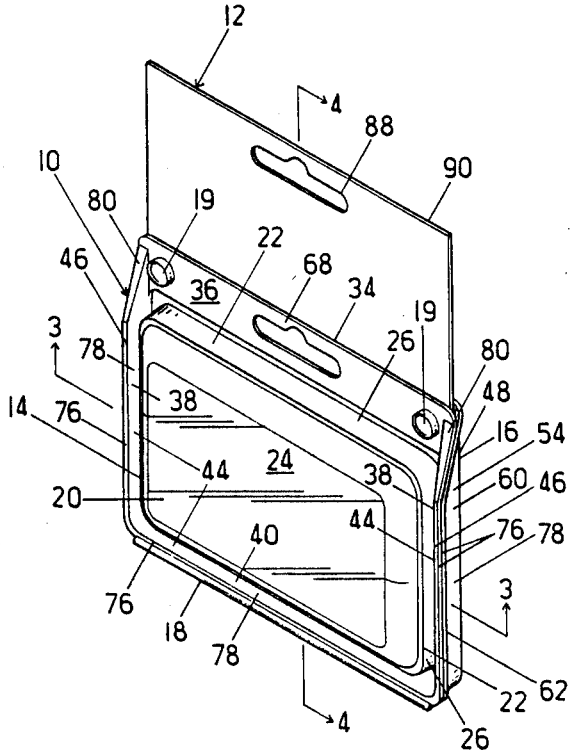
FIG. 2 is a rear perspective view of a reclosable display package with an inscription card within and extending out from the package.

With reference to the drawings, a reclosable display package 10 in its open position with flat inscription card 12 projected away from the package 10 is shown generally in FIG. 1. FIG. 2 shows the package 10 and flat inscription card 12 with the package 10 closed over the flat inscription card 12. The reclosable display package 10 is thermoformed from thin, flexible plastic material and includes a rear base 14, a front cover 16 which is integrally hinged along a hinge line 18 to the rear base 14, and means 19 for releasably locking the front cover 16 in a closed position on the rear base 14.

The rear base 14 and front cover 16, as shown in FIGS. 1 and 2, have generally rectangular shapes. The rectangular shapes as shown are for illustrative purposes only. The rear base 14 and front cover 16 could have any desired configuration, for example, round, oblong, rectangular or polygonal, etc.

Figure 3:
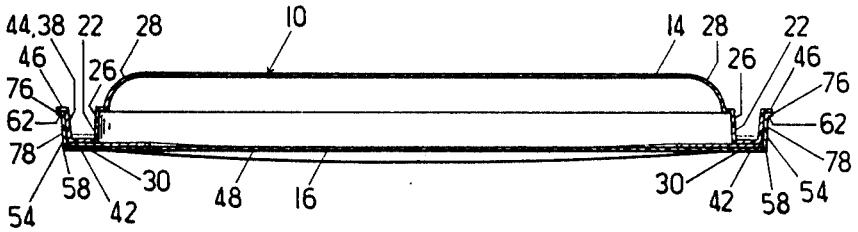
FIG. 3 is a cross-sectional view taken along section line 3—3 of FIG. 2.
Figure 4:
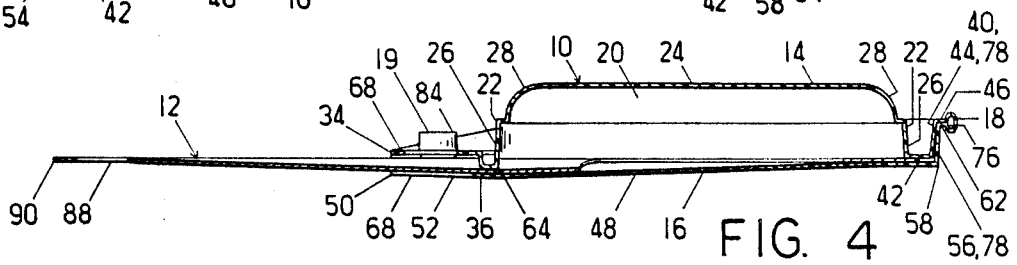
FIG. 4 is a cross-sectional view taken along section 4—4 of FIG. 2.

The rear base 14 of the preferred display package 10 has a rearward recess 20 in which articles to be displayed are contained. The rearward recess 20 of the preferred reclosable display package 10 is defined by four walls 22 which extend rearwardly to a rear wall 24. The four walls 22 are integrally connected to the rear wall 24 and to each other. These four walls 22 further include an annular skirt wall 26 which is spaced outwardly from the remaining portions 28 of the walls 22. The combined structure of the annular skirt 26 with the remaining portions 28 of the walls 22 give the walls 22 of the rearward recess 20 additional strength. The rear base 14 further has a substantially flat mating surface 30 which surrounds the recess 20 at the margin 32 of the recess 20 where the four walls 22 join with the flat mating surface 30. The substantially flat mating surface 30 extends upwardly to a rear top edge 34. The upper portion 36 of the flat mating surface 30 extends between the recess 20 and the rear top edge 34 of the flat mating surface 30. The rear base 14 also has two rear base side flanges 38 and one rear base bottom flange 40, all of which extend rearwardly from three other edges 42 of the flat mating surface 30 to form a rear base skirt 44. The two rear base side flanges 38 are each beveled forwardly along an external rearward edge 46 as is shown most clearly in FIGS. 1 and 3. The preferred front cover 16 includes a front plane 48 which extends upwardly to its front top edge 50. The upper portion 52 of the front plane 48 is that portion of the front plane 48 which mates with the upper portion 36 of the flat mating surface 30 when the package 10 is closed. The front cover 16 further includes two front cover side flanges 54 and one front cover bottom flange 56, all of which extend rearwardly from three other edges 58 of the front plane 48 to form a front cover skirt 60. The two front cover side flanges 54 are each beveled forwardly along an external rearward edge 62 toward the front top edge 50, similarly as are the two beveled rear base side flanges 38. When the front cover 16 is in a closed position on the rear base 14, the front cover flanges 54 and 56 telescopically mate around the rear base flanges 38 and 40, and the flat mating surface 30 mates with the front plane 48. The front cover 16 is integrally hinged by its non-beveled bottom flange 56 to the non-beveled rear base bottom flange 40 and is moveable between open and closed positions.

The substantially flat mating surface 30 of the preferred reclosable display package 10 includes a bowed ridge 64 along a top margin 66 of the rearward recess 20 which is opposite the hinge line 18. The bowed ridge 64 prevents the escape of articles contained in the recess 20 between the front plane 48 of the front cover 16 and flat mating surface 30 of the rear base 14 when the package 10 is closed.

The upper portion 52 of the flat mating surface 30 above the rearward recess 20 forms a hang tab 68 by which the package 10 may be hung for displaying articles when the package 10 is closed. The front top edge 50 of the preferred display package 10 has a central indentation 70 and a portion 72 of the flat mating surface 30 of the rear base 14 which lies to the rear of the indentation 70 when the front cover 16 is closed has a first opening 74 through which the display package 10 without card 12 may be hung. Alternatively, the upper portions 36 and 52 of either or both the front plane 48 and the flat mating surface 30 above the rearward recess 20 may form the hang tab 68 by which the package 10 is hung. Each front cover flange 54 and 56 and each rear base flange 38 and 40 includes a flange extension 76 which extends outwardly from a rearward edge 46 and 62 of a main flange portion 78. These flange extensions 76 increase the rigidity of the flanges 38, 40, 54, and 56.

Although the present invention may have side flanges 38 and 54 which are beveled in various ways, the preferred reclosable display package 10 has rear base side flanges 38 and front cover side flanges 54 which are beveled forwardly toward the rear top edge 34 and the front top edge 50 along only an upper portion 80 of those flanges 38 and 54. Additionally, the upper portions 80 of these side flanges 38 and 54 are beveled at about a 15° angle.

The releasable locking means 19 of the preferred reclosable display package 10 includes two locking projections 82 which are near the front top edge 50, and two locking cavities 84 located near the rear top edge 34. When the front cover 16 is in a closed position on the rear base 14, the locking projections 82 fit snugly within the locking cavities 84 to releasably lock the front cover 16 in a closed position. To lock the front cover 16 into a closed position on the rear base 14, a user should push the locking projections 82 into the locking cavities 84. To open the closed display package 10, the user should place his/her finger near the locking projections 82 and cavities 84 and pull the front plane 48 away from the flat mating surface 30.

The preferred package 10 includes a flat inscription card 12 which when in proper position within the closed package 10, lies against the front plane 48 of the front cover 16. The preferred flat inscription card 12 extends upwardly beyond the front top edge 50 and rear top edge 34 of the package 10, as shown in FIG. 2. Alternatively, the flat inscription card 12 may extend upwardly so that it is flush with the front top edge 50 and rear top edge 34. When the flat inscription card 10 extends beyond the front top edge 50 and rear top edge 34, a second opening will be located near the top end 90 of the card 12 so that the second opening 88 may be used for hanging the display package 10 with inscription card 12. Since the preferred reclosable display package 10 has two locking projections 82 which fit into two locking cavities 84, the inscription card 12 has two holes 92, one hole for each locking projection to extend therethrough so that when the front cover 16 is in a closed position on the rear base 14, the flat inscription card 12 does not impede the fit of the locking projections 82 into the locking cavities 84. The flat mating surface 30 of the rear base 14 will mate with the front plane 48 of the front cover 16 so that the flat mating surface 30 and the front plane 48 are separated by only the flat non-folded inscription card 12. If another releasable locking means 19 is used, it is possible that no holes 92 for locking projections 82 would be required in the flat inscription card 12. Alternative releasable locking means could include various components such as tabs and slots, hooks, releasable adhesives, etc., and still be considered within the present invention.

An open display package 10 may be removably nested with other open display packages 10 which are constructed in like manner. Each of the recess's four walls 22 are angularly oriented at substantially a first angle in an outward direction with respect to a plane which is normal to the rear wall 24. Additionally, each front cover flange 54 and 56 is angularly oriented at a second angle in an outward direction with respect to a plane which is normal to the front plane 48. Accordingly, each rear base flange 38 and 40 is also angularly oriented at a second angle in an outward direction with respect to a plane which is normal to the flat mating surface. Since the display packages 10 are nestable with each other, they will take up a minimum of volume when being stored or transported.

It is understood that the invention is not confined to the particular construction and arrangement herein illustrated and described, but embraces such modified forms thereof as come within the scope of the following claims.

What is claimed is:

1. A reclosable display package of thin flexible thermoformed plastic material, comprising:

(a) a rear base having a rearward recess for containing any articles to be displayed, a substantially flat mating surface surrounding the recess and extending upwardly to a rear top edge, and two rear base side flanges and one rear base bottom flange which extend rearwardly from three other edges of the flat mating surface to form a rear base skirt, the two rear base side flanges each being beveled forwardly along an external rearward edge toward the rear top edge; and (b) a front cover hinged to the rear base and movable between open and closed positions, the front cover having a front plane which extends upwardly to a front top edge, two front cover side flanges and one front cover bottom flange which extend rearwardly from three other edges of the front plane to form a front cover skirt, the front cover bottom flange being hinged to the rear base bottom flange at a hinge line which is a continuation of the material forming the hinged bottom flanges, the two front cover side flanges each being beveled forwardly along an external rearward edge toward the front top edge such that when the front cover is in a closed position on the rear base the front cover flanges telescopically mate around the rear base flanges, the flat mating surface mates with the front plane and the beveled flanges of the rear base and front cover slant forwardly to respectively terminate in the planes of the rear base flat mating surface and the front cover front plane, whereby a flat, non-folded inscription card may be received between the flat mating surface and the front plane with the card extending beyond the top edges of the rear base and cover in planar relation when the cover is in its closed position.

2. The reclosable display package specified in claim 1 wherein the substantially flat mating surface of the rear base includes a bowed ridge along a top margin of the rearward recess which is opposite the hinge line, the bowed ridge preventing the escape of articles within the recess out between the front plane of the front cover and flat mating surface of the rear base, when the package is closed.

3. The reclosable display package specified in claim 1 wherein the front top edge has a central indentation and a portion of the flat mating surface of the rear base which lies to the rear of the indentation when the front cover is closed has a first opening through which the display package may be hung for displaying the articles in the rearward recess.

4. The reclosable display package specified in claim 1 wherein upper portions of at least one of the front plane and flat mating surface above the rearward recess form a hang tab by which the package may be hung for displaying articles when the package is closed.

5. The reclosable display package specified in claim 1 wherein each front cover flange and each rear base flange includes a flange extension which extends outwardly from a rearward edge of a main flange portion increasing the rigidity of the flanges.

6. The reclosable display package specified in claim 1 wherein the rear base side flanges and the front cover side flanges are beveled forwardly toward the rear top edge and the front top edge along only an upper portion of those flanges.

7. The reclosable display package specified in claim 6 wherein the beveled flanges are beveled at about a 15° angle along their upper portion.

8. The reclosable display package specified in claim 1 further including a means for releasably locking the front cover in a closed position on the rear base.

9. The reclosable display package specified in claim 8 wherein the releasable locking means includes at least one locking projection near the front top edge, and an equal number of locking cavities near the rear top edge, and wherein when the front cover is in a closed position on the rear base the locking projections fit snugly within the locking cavities to releasably lock the front cover in a closed position.

10. The reclosable display package specified in claim 9 further including a flat inscription card which lies against the front plane of the front cover, the inscription card having one hole for each locking projection to extend therethrough, such that when the front cover is in a closed position on the rear base and flat inscription card, the flat mating surface mates with the front plane, being separated from the front plane by only the flat non-folded inscription card.

11. The reclosable display package specified in claim 1 wherein the rearward recess is defined by four walls which extend rearwardly from the flat mating surface to the rear wall, the four walls being integrally connected to the rear wall and to each other.

12. The reclosable display package specified in claim 11 wherein the four walls are angularly oriented at substantially a first angle in an outward direction with respect to planes which are normal to the rear wall, the front cover flanges are angularly oriented at a second angle in an outward direction with respect to planes which are normal to the front plane, and the rear base flanges are also angularly oriented at the second angle in an outward direction with respect to planes which are normal to the flat mating surface so that the open display package may be removably nested with another open display package constructed in like manner.

13. The reclosable display package specified in claim 1 further including a flat inscription card which lies against the front plane of the front cover, such that when the front cover is in a closed position on the rear base and flat inscription card, the flat mating surface mates with the front plane, being separated from the front plane by only the flat non-folded inscription card.

14. The reclosable display package specified in claim 13 wherein the flat inscription card extends upwardly to the front top edge and the rear top edge.

15. The reclosable display package specified in claim 13 wherein the flat inscription card extends upwardly beyond the front top edge and the rear top edge.

16. The reclosable display package specified in claim 15 wherein the flat inscription card has a top end near which the card has a second opening through which the display package with card may be hung for displaying the articles in the rearward recess.

* * * * *